US012736290B2

(12) United States Patent
Wu et al.

(10) Patent No.: US 12,736,290 B2
(45) Date of Patent: Sep. 15, 2026

(54) HEAT EXCHANGER AND ASSEMBLY METHOD THEREFOR

(71) Applicant: ZHEJIANG SANHUA AUTOMOTIVE COMPONENTS CO., LTD., Hangzhou (CN)

(72) Inventors: Qinghao Wu, Hangzhou (CN); Qie Shen, Hangzhou (CN); Jintao Zhao, Hangzhou (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 335 days.

(21) Appl. No.: 17/784,147

(22) PCT Filed: Dec. 11, 2020

(86) PCT No.: PCT/CN2020/135528
§ 371 (c)(1),
(2) Date: Jun. 10, 2022

(87) PCT Pub. No.: WO2021/115402
PCT Pub. Date: Jun. 17, 2021

(65) Prior Publication Data

US 2023/0032094 A1 Feb. 2, 2023

(30) Foreign Application Priority Data

Dec. 12, 2018 (CN) ..... 201911271952.6

(51) Int. Cl.
*F28D 7/16* (2006.01)
*F28F 9/02* (2006.01)
(Continued)

(52) U.S. Cl.
CPC ..... *F28D 7/1623* (2013.01); *F28D 7/1692* (2013.01); *F28F 9/0224* (2013.01);
(Continued)

(58) Field of Classification Search
CPC ..... F28D 7/1623; F28D 7/1646; F28F 21/06; F28F 9/0224; F28F 9/0221
See application file for complete search history.

(56) References Cited

U.S. PATENT DOCUMENTS 9,874,404 B2 1/2018 Sauter et al.
2003/0188857 A1* 10/2003 Kawakubo ..... F28F 9/0243 165/174
(Continued)

FOREIGN PATENT DOCUMENTS

CN 1620589 A 5/2005
CN 101622510 A 1/2010
(Continued)

OTHER PUBLICATIONS

Translation of Patent Document WO2017097133A1 named TRANSLATION-WO2017097133A1 (Year: 2017).*
(Continued)

*Primary Examiner* — Paul Alvare
(74) *Attorney, Agent, or Firm* — Ohlandt, Greeley and Perle, L.L.P.

(57) ABSTRACT

A heat exchanger has a housing and a core body accommodated in the housing. The housing includes a first body and a second body. The first body is a metal material. The second body is a plastic material. The first body and the second body are connected to each other so as to form a first cavity. The core body is accommodated in the first cavity. The core body is fixedly connected to the first body. The core body includes multiple heat exchange tubes. A first fluid channel is formed between the heat exchange tubes. A second fluid channel is formed in the heat exchange tube. The heat exchanger is further provided with a connecting block. The connecting block is fixed to the first body, and the connecting block is
(Continued)

located outside the first cavity. The connecting block is provided with a first flow-through hole.

17 Claims, 4 Drawing Sheets

(51) Int. Cl.
*F28F 21/06* (2006.01)
*F28F 21/08* (2006.01)

(52) U.S. Cl.
CPC ..... *F28F 9/0278* (2013.01); *F28F 21/06* (2013.01); *F28F 21/08* (2013.01); *F28D 7/1646* (2013.01); *F28F 9/0221* (2013.01); *F28F 2275/06* (2013.01)

(56) References Cited

U.S. PATENT DOCUMENTS

| | | | | |
|---|---|---|---|---|
| 2005/0284621 | A1* | 12/2005 | Katoh | F28F 9/0221 165/174 |
| 2009/0266104 | A1* | 10/2009 | Ichiyanagi | F28F 9/0253 165/173 |
| 2011/0120671 | A1* | 5/2011 | Brauning | F28F 9/02 165/96 |
| 2012/0210955 | A1* | 8/2012 | Keerl | F02B 29/0462 123/41.56 |
| 2013/0264037 | A1* | 10/2013 | Otsubo | F28F 9/0224 165/157 |
| 2014/0299295 | A1* | 10/2014 | Kalbacher | F28F 9/26 165/76 |
| 2014/0318749 | A1* | 10/2014 | Katoh | F28D 1/05391 165/151 |
| 2017/0016685 | A1* | 1/2017 | Hohmann | F28F 21/06 |
| 2017/0328638 | A1* | 11/2017 | Wu | F28F 9/0221 |
| 2018/0363988 | A1* | 12/2018 | Liu | F28F 1/128 |
| 2020/0018552 | A1* | 1/2020 | Kimmel | F28F 9/0226 |
| 2021/0285408 | A1* | 9/2021 | Burckel | F28F 9/0253 |

FOREIGN PATENT DOCUMENTS

| | | | | | |
|---|---|---|---|---|---|
| CN | 106642654 | A | | 5/2017 | |
| CN | 107120871 | A | | 9/2017 | |
| CN | 107289675 | A | * | 10/2017 | B60H 1/00342 |
| CN | 107687787 | A | | 2/2018 | |
| DE | 102015111393 | A1 | | 4/2016 | |
| EP | 3327396 | A1 | * | 5/2018 | F02M 35/10026 |
| JP | 85528476 | A | | 2/1980 | |
| WO | WO-2017097133 | A1 | * | 6/2017 | B60H 1/00342 |
| WO | WO-2019053213 | A1 | * | 3/2019 | F28D 7/1692 |
| WO | 2019183312 | A1 | | 9/2019 | |
| WO | WO-2020110639 | A1 | * | 6/2020 | F28F 1/128 |

OTHER PUBLICATIONS

Translation of CN107289675A named TRANSLATION-CN107289675A (Year: 2017).*
Translation of WO2020110639A1 named TRANSLATION-WO2020110639A1 (Year: 2020).*
International Search Report dated Mar. 10, 2021 for PCT Appl. No. PCT/CN2020/135528.
Extended European Search Report dated Nov. 3, 2023 for European Appl. No. 20898106.8.

* cited by examiner

HEAT EXCHANGER AND ASSEMBLY METHOD THEREFOR

The present disclosure is a national phase application of PCT international patent application PCT/CN2020/135528, filed on Dec. 11, 2020, which claims the benefit of priority to Chinese patent application No. 201911271952.6, titled as "HEAT EXCHANGER AND ASSEMBLY METHOD THEREFOR", filed with the Chinese State Intellectual Property Office on Dec. 12, 2019, the entire disclosures of which is incorporated herein by reference.

BACKGROUND

1. Field of the Disclosure

The present disclosure relates to the technical field of heat exchange, and in particular to a heat exchanger and an assembly method therefor.

2. Discussion of the Background Art

In some high-pressure heat exchangers, a connecting block and a heat exchange core body are arranged in a cavity of a housing after being integrally formed. An accommodating hole is provided in the housing, a part of the connecting block extends into the cavity after passing through the accommodating hole, another part is located outside the housing, and a sealing structure is provided between the connecting block and the accommodating hole to seal the cavity. In addition, in order to enable the heat exchange core body to be accommodated in the cavity, the housing can be divided into an upper portion and a lower portion, and a sealing structure needs to be further provided between the upper and lower portions.

SUMMARY

An object according to the present disclosure is to provide a heat exchanger, which includes:

a housing and a core body accommodated in the housing, where the housing includes a first body and a second body, the first body is made of metal, the second body is made of plastic, and the first body and the second body are connected to form a first cavity; the core body is accommodated in the first cavity, the core body is fixedly connected to the first body, the heat exchanger is provided with first fluid passages in the first cavity, second fluid passage are formed inside the multiple heat exchange pipes, and the first fluid passages are not in communication with the second fluid passage; the heat exchanger further includes a connecting block, the connecting block is fixed to the first body and the connecting block is located outside the first cavity, a first flow-through hole is provided in the connecting block, a second flow-through hole is provided in the first body, and the first flow-through hole is in communication with the second fluid passages through the second flow-through hole.

According to the present disclosure, the heat exchanger includes the core body, the housing and the connecting block, the first cavity is formed in the housing, the connecting block is fixed to the hosing and the connecting block is arranged outside the first cavity, the core body is fixedly arranged in the first cavity, and the first flow-through hole is in communication with the multiple heat exchange pipes through the second flow-through hole, so as to enhance the connection strength and sealing between the core body and the housing.

Figure 1:
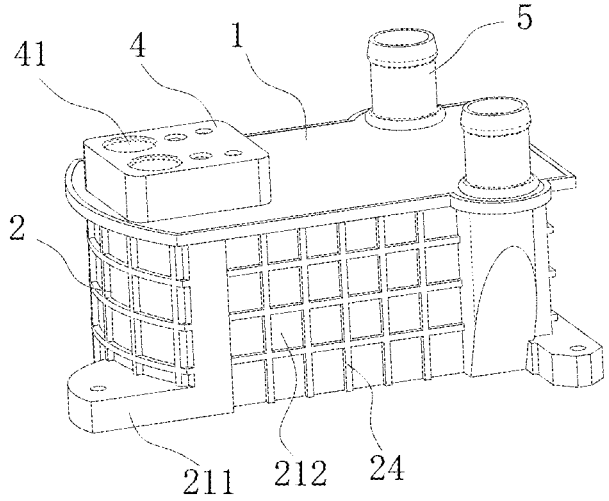
FIG. 1 is a perspective structural view of a heat exchanger in a first embodiment of the present disclosure.

Reference numerals in the drawings are as follows:

| | | | |
|---|---|---|---|
| 1 | first body; | 11 | second flow-through hole; |
| 12 | protruding portion; | 13 | first abutment portion; |
| 14 | buckle portion; | 141 | straight portion; |
| 142 | blocking portion; | 15 | first body portion; |
| 16 | clamp slot; | 161 | first extending portion; |
| 162 | second extending portion; | 163 | third extending portion; |
| 17 | second hole; | | |
| 2 | second body; | 21 | tank portion; |
| 211 | bottom plate; | 212 | side plate; |
| 2121 | are portion; | 22 | second abutment portion; |
| 23 | clamping edge; | 24 | reinforcing rib; |
| 31 | heat exchange pipe; | 32 | first collecting assembly; |
| 321 | collecting pipe; | 322 | flow-through plate; |
| 3221 | distribution passage; | 323 | first connecting plate; |
| 3231 | first heat exchange pipe mounting groove; | | |
| 33 | second collecting assembly; | 331 | second connecting plate; |
| 3311 | second heat exchange pipe mounting groove; | | |
| 332 | baffle plate; | 3321 | baffle passage; |
| 334 | enclosure plate; | | |
| 4 | connecting block; | 41 | first flow-through hole; |
| 5 | external connecting pipe. | | |

DETAILED DESCRIPTION OF THE EMBODIMENTS

First Embodiment

Figure 2:
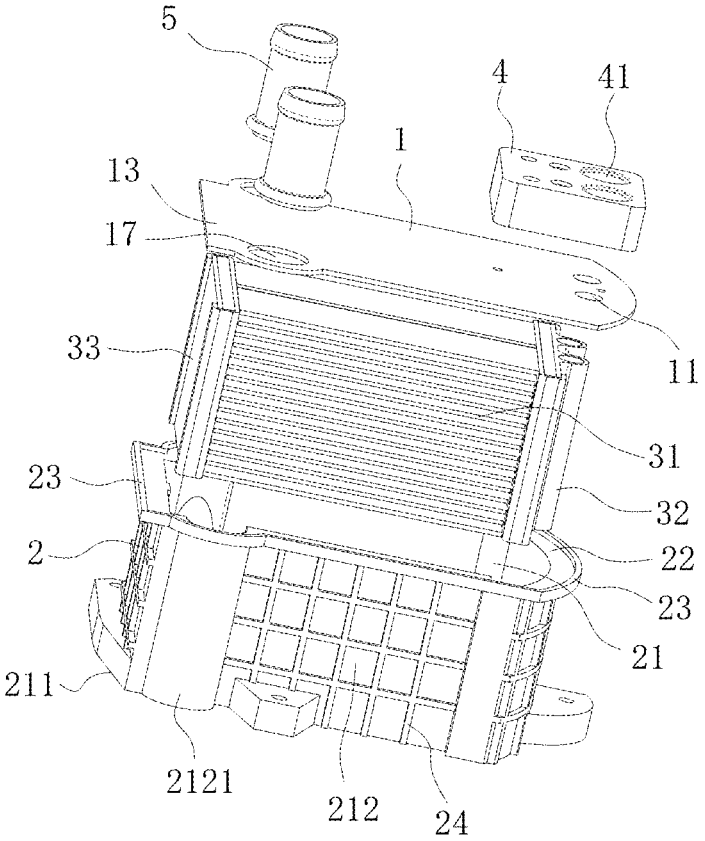
FIG. 2 is an exploded view of the heat exchanger in the first embodiment of the present disclosure.
Figure 3:
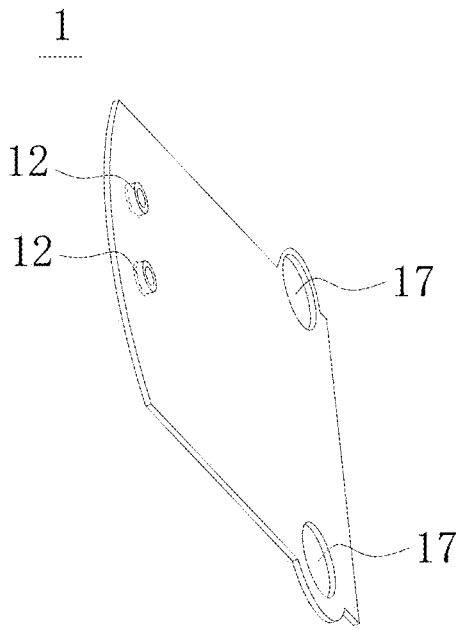
FIG. 3 is a schematic structural view of a first body in the first embodiment of the present disclosure.

Referring to FIG. 2 and FIG. 3, a heat exchanger includes a housing, the housing includes a first body 1 and a second body 2, the first body 1 is made of metal, the second body 2 is made of plastic, the first body 1 is in a flat-plate shape, and a second flow-through hole 11 is provided in the first body 1.

Figure 4:
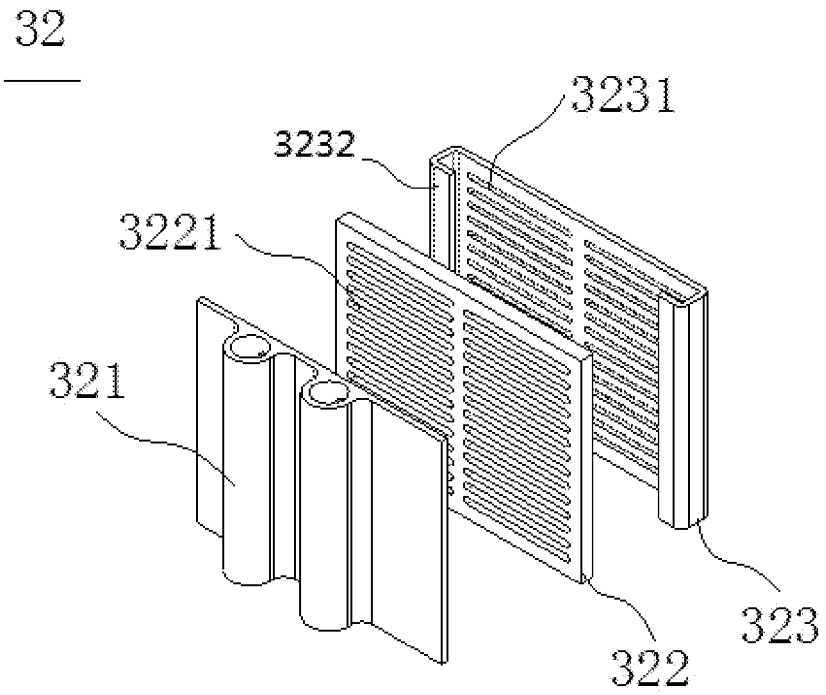
FIG. 4 is a exploded view of a first collecting assembly in the first embodiment of the present disclosure.

Referring to FIG. 2 and FIG. 4, the core body includes multiple heat exchange pipes 31 and a first collecting assembly 32, second fluid passage are formed inside the multiple heat exchange pipes 31, first fluid passages are formed between the multiple heat exchange pipes 31, the first collecting assembly 32 is in communication with the multiple heat exchange pipes 31, the first collecting assembly 32 includes a collecting pipe 321, a flow-through plate 322 and a first connecting plate 323, multiple first heat exchange pipe mounting grooves 3231 are provided in the first connecting plate 323 along a length direction of the first connecting plate 323, one end of the multiple heat exchange pipes 31 is arranged in the multiple first heat exchange pipe mounting grooves 3231, the collecting pipe 321 is arranged on a side of the first connecting plate 323 away from the multiple heat exchange pipes 31, a throttling passage is provided on the collecting pipe 321 along an arrangement direction of the multiple first heat exchange pipe mounting grooves 3231, the flow-through plate 322 is arranged between the collecting pipe 321 and the first connecting plate 323, and distribution passages 3221 are provided in the flow-through plate 322 along the arrangement direction of the multiple first heat exchange pipe mounting grooves 3231, and the throttling passage is in communication with the multiple heat exchange pipes 31 through the distribution passages 3221.

Figure 5:
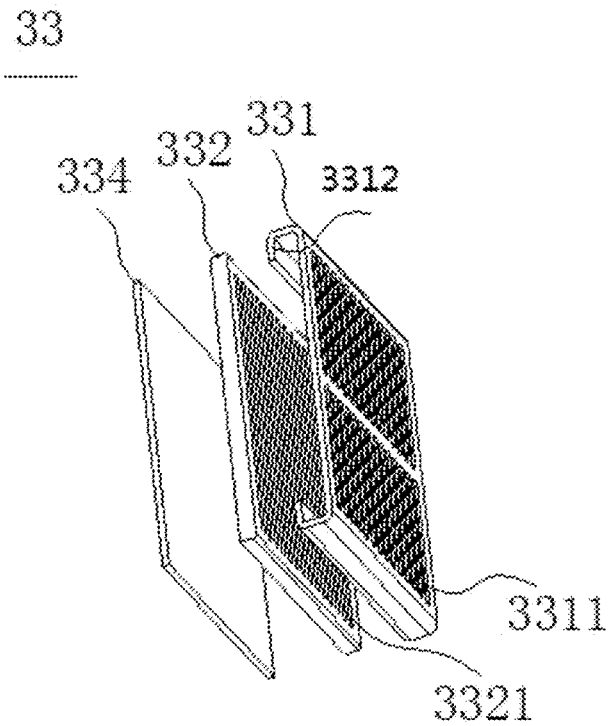
FIG. 5 is a exploded view of a second collecting assembly in the first embodiment of the present disclosure.

Referring to FIG. 2 and FIG. 5, the core body further includes a second collecting assembly 33, the second collecting assembly 33 includes a second connecting plate 331, a baffle plate 332 and an enclosure plate 334, multiple second heat exchange pipe mounting grooves 3311 are provided in the second connecting plate 331 along a length direction of the second connecting plate 331, another ends of the multiple heat exchange pipes 31 are arranged in the multiple second heat exchange pipe mounting grooves 3311, the enclosure plate 334 is arranged on a side of the second connecting plate 331 away from the multiple heat exchange pipes 31, the baffle plate 332 is arranged between the enclosure plate 334 and the second connecting plate 331, baffle passages 3321 in communication with the multiple second heat exchange pipe mounting grooves 3311 are provided in the baffle plate 332 along an arrangement direction of the multiple second heat exchange pipe mounting grooves 3311. As shown in FIG. 5, the baffle passages 3321 are in a long-strip shape, two columns of the heat exchange pipes 31 are in communication by the second connecting plate 331 to form a U-shaped circuit. By forming the U-shaped circuit, the heat exchange efficiency of the heat exchanger is improved.

Referring to FIGS. 4 to 5, two collecting pipes 321 are provided, which are arranged side by side on one side of the multiple heat exchange pipes 31. As shown in FIG. 4, specifically, the two collecting pipes 321 are arranged on a same plate body and can be integrally formed on the plate body, one collecting pipe 321 is used as a passage for the fluid flowing in the multiple heat exchange pipes 31, the other collecting pipe 321 is used as a passage for the fluid flowing out through the multiple heat exchange pipes 31, the throttling passages and the multiple first heat exchange pipe mounting grooves 3231 are arranged in two columns, the distribution passages 3221 are provided in the flow-through plate 322 along the arrangement direction of the multiple first heat exchange pipe mounting grooves 3231, the distribution passages 3221 are arranged in two columns, each distribution passage 3221 corresponds to one first heat exchange pipe mounting groove 3231, and each distribution passage 3221 corresponds to one throttling passage, which increases the uniformity of fluid distribution and improves the heat exchange effect. As shown in FIG. 4, two sides of the second connecting plate 323 both include a hemming part 3232, and the hemming parts 3232 can be L-shaped as shown in FIG. 4, so that U-shaped clamp slots are formed at positions where the hemming parts 3232 are. During mounting, two sides of the flow-through plate 322 and two sides of the plate body provided with the collecting pipes 321 can be press-fitted in the hemming parts 3232, that is, clamped and pressed in the clamp slots formed by the hemming parts 3232, so as to improve the reliability of mounting and save space.

The core body further includes a second collecting assembly 33, the second collecting assembly 33 includes a second connecting plate 331, a baffle plate 332 and an enclosure plate 334, multiple second heat exchange pipe mounting grooves 3311 are provided on the second connecting plate 331 along a length direction of the second connecting plate 331, the multiple second heat exchange pipe mounting grooves 3311 are arranged in two columns, another end of the multiple heat exchange pipes is arranged in the multiple second heat exchange pipe mounting grooves 3311, the enclosure plate 334 is arranged on a side of the second connecting plate 331 away from the multiple heat exchange pipes 31, the baffle plate 332 is arranged between the enclosure plate 334 and the second connecting plate 331, baffle passages 3321 in communication with the multiple second heat exchange pipe mounting grooves 3311 are provided in the baffle plate 332 along an arrangement direction of the multiple second heat exchange pipe mounting grooves 3311, and the baffle passages 3321 are arranged in a column to form a rows-in-series structure. Each baffle passage 3321 corresponds to two second heat exchange pipe mounting grooves in a same row of the two columns, which saves the spaced occupied by the core body, thus greatly reduces the volume of the heat exchanger under the premise of satisfying the heat exchange efficiency. As shown in FIG. 5, two sides of the second connecting plate 331 both include a hemming part 3312, and the hemming parts 3312 can be L-shaped as shown in FIG. 5, so that U-shaped clamp slots are formed at positions where the hemming parts 3312 are. During mounting, two sides of the enclosure plate 334 and two sides of the baffle plate 332 are press-fitted in the hemming parts 3312, that is, clamped and pressed in the clamp slots formed by the hemming parts 3312, so as to improve the reliability of mounting and save space.

Alternatively, the second collecting assembly 33 can be arranged in a same structure with the first collecting assembly 32, that is, the two first collecting assemblies 32 are arranged at two ends of the multiple heat exchange pipes 31, respectively.

Alternatively, each distribution passage 3221 can correspond to multiple first heat exchange pipe mounting grooves 3231 in a same column, and each distribution passage 3221 can correspond to multiple throttling passages. The specific corresponding relationship can be set according to specific requirements, which will not be described here.

Referring to FIGS. 2 to 3, the core body is fixedly arranged on one side of the first body 1, the side of the first body 1 in contact with the core body is provided with a solder composite layer, or a side of the core body in contact with the first body 1 is provided with a solder composite layer, or the side of the first body 1 in contact with the core body and the side of the core body in contact with the first body 1 are both provided with a solder composite layer. Taking the case that the side of the first body 1 in contact with the core body being provided with the solder composite layer as an example, the core body is welded to the first body 1 by the solder composite layer, which enhances the strength of the heat exchanger and the reliability of the heat exchanger. The second flow-through hole 11 is in communication with the second fluid passages through the collecting pipe 321. Furthermore, a protruding portion 12 extending along a circumferential direction of the second flow-through hole 11 toward a side where the core body is located is provided at the second flow-through hole 11, and the protruding portion 12 extends into the collecting pipe 321 through an opening of the collecting pipe 321. The protruding portion 12 can facilitate the positioning of the core body, and reduce the risk of deviation of the core body relative to the first body 1, and facilitate the assembly of the core body with the first body 1. Furthermore, an outer wall of the protruding portion 12 in contact with the collecting pipe 321 is provided with a solder composite layer, the protruding portion 12 can be welded to an inner side wall of the collecting pipe 321 by the solder composite layer arranged on the outer wall of the protruding portion 12, which improves the welding strength between the core body and the first body 1. In addition, since the protruding portion 12 is welded to the collecting pipe 321, it improves the sealing performance between the second flow-through hole 11 and the collecting pipe 321, prevents medium flowing through the second flow-through hole 11 from leaking into the first fluid passages between the multiple heat exchange pipes 31 during the process of flowing into the second fluid passages in the heat exchange pipes 31, which further improves the heat exchange effect of the heat exchanger.

Referring to FIGS. 1 to 2, the heat exchanger further includes a connecting block 4, which is fixedly arranged on a side of the first body 1 away from the core body, a first flow-through hole 41 is provided in the connecting block 4 along a thickness direction of the connecting block 4, and a second flow-through hole 11 is in communication with the second fluid passages through the first flow-through hole 41, that is, the first flow-through hole 41, the second flow-through hole 11 and the second fluid passages are in communication in sequence. A side of the first body 1 in contact with the connecting block 4 is provided with a solder composite layer, or a side of the connecting block 4 in contact with the first body 1 is provided with a solder composite layer, or the side of the first body 1 in contact with the connecting block 4 and the side of the connecting block 4 in contact with the first body 1 are both provided with a solder composite layer. Taking the case that the side of the connecting block 4 in contact with the first body 1 is provided with the solder composite layer as an example, the connecting block 4 is welded to the first body 1 by the solder composite layer, which enhances the connection strength between the connecting block 4 and the first body 1, improves the sealing between the first flow-through hole 41 and the second flow-through hole 11, and reduces the risk of heat exchange leakage. In addition, since the connecting block 4 and the core body are arranged on two sides of the first body 1, respectively, it is not necessary to provide an accommodating hole for accommodating the connecting block 4 in the first body 1, so that the core body does not need to be connected in the first body 1 by the connecting block 4 being accommodated in the accommodating hole, which reduces the risk of the relative movement between the core body and the first body 1 caused by frequent vibration. In addition, since the second flow-through hole 11 with a small diameter is provided in the first body 1, it is not necessary to provide an accommodating hole with a large diameter for accommodating the connecting block 4, which greatly reduces the difficulty of sealing and effectively reduces the risk of leakage of the heat exchanger.

Referring to FIGS. 1 to 2, the second body 2 has a U-shaped tank portion 21, the U-shaped herein means that a cross section is substantially U-shaped, and the second body 2 is made of plastic, to reduce the weight of the heat exchanger. The second body 2 includes a bottom plate 211 and side plates 212. The number of side plates 212 is four, the four side plates 212 are sealingly connected end to end in sequence, and the four side plates 212 are arranged substantially vertically on the bottom plate 211, and portions of the four side plates 212 in contact with the bottom plate 211 are sealed, the tank portion 21 is formed by enclosure of the bottom plate 211 and the four side plates 212, one of the four side plates 212 is configured in an arc shape, a second abutment portion 22 is provided at the top of the four side plates 212, a first abutment portion 13 is provided on an outer circumference of the first body 1, and the first abutment portion 13 is bonded with the second abutment portion 22 with glue, so that the first body 1 is connected to the second body 2 to form the first cavity. The core body is arranged in the first cavity, and the collecting pipe 321 is arranged close to the arc side plate 212. Alternatively, the number of the side plates 212 may be any, which can be arranged according to needs. Furthermore, the first abutment portion 13 is integrally formed with the first body 1, that is, the first abutment portion 13 is an outer circumferential portion of the first body 1.

Referring to FIGS. 1 to 2, the arc portions 2121 are provided on two side plates 212 connected to the arc side plate 212, respectively, a first duct is formed between the arc portions 2121 and the core body, a second hole 17 in communication with the first duct is provided in the first body 1, and two sides of the first body 1 protrude outward to form arc portions of the second hole 17 which correspond to the arc portions 2121 on the two side plates 212. The core body includes multiple heat exchange pipes 31, first fluid passages are formed between the multiple heat exchange pipes 31, the second hole 17 is in communication with the first fluid passages through the first duct, that is, the second hole 17, the first duct and the first fluid passages are in communication in sequence. The heat exchanger further includes an external connecting pipe 5, and one end of the external connecting pipe 5 is sealingly connected to the second hole 17. The arc portions 2121 provided herein are mainly configured to form the first duct with the core body, so as to be in communicating with the first fluid passages. The side plates 212 may be just arranged protruding outward, which is not limited to be in arc portion 2121. As an example, a refrigerant can be flow through the second fluid passages in the heat exchange pipes 31, and various heat exchange fluids, such as water, can be flow through the first fluid passages outside the multiple heat exchange pipes 31.

Furthermore, referring to FIG. 2, a clamping edge 23, which extends along a circumferential direction of the second abutment portion 22 toward a direction where the first body 1 is located, is provided on the second abutment portion 22, the clamping edge 23 is continuously arranged along an open end of the second body 2, and a side wall of the first abutment portion 13 abuts against the clamping edge 23. During the assembly of the first body 1 and the second body 2, the first abutment portion 13 can be moved along the clamping edge 23 in a direction close to the second abutment portion 22 until the first abutment portion 13 abuts against the second abutment portion 22, which facilitates of the mounting and alignment of the first body 1 and the second body 2. In addition, the arrangement of the clamping edge 23 reduces the possibility of glue overflow.

Referring to FIGS. 1 to 2, reinforcing ribs 24 are provided outside the second body 2, so as to further improve the impact resistance of the heat exchanger and improve the service life of the heat exchanger. The reinforcing ribs 24 are arranged in a bar-shape. The number of the reinforcing ribs 24 is plural.

Second Embodiment

The structure and principle of the second embodiment is substantially the same with the first embodiment, and the difference is in that: the first body 1 is connected to the second body by a buckle, that is, a buckle portion 14 is provided on the first abutment portion 13, and the first abutment portion 13 is pressed against and fixed to the second abutment portion 22 by the buckle portion 14.

Figure 6:
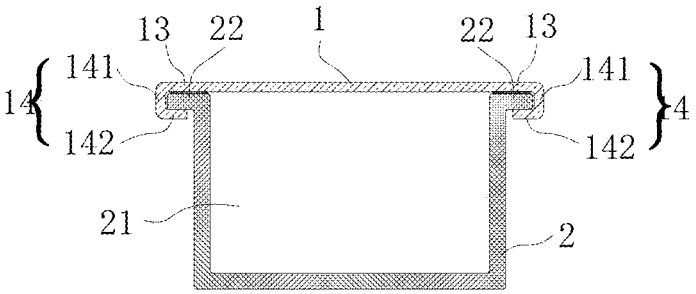
FIG. 6 is a simple schematic assembly view of the first body and the second body in a second embodiment of the present disclosure.

Referring to FIG. 6, the buckle portion 14 is provided on the first abutment portion 13 along a circumferential direction of the first abutment portion 13, the number of the buckle portion 14 is plural, and each buckle portion 14 protrudes from the first abutment portion 13 along a direction where the second abutment portion 22 is located. After the first abutment portion 13 is aligned with the second abutment portion 22, the end of the buckle portions 14 away from the first abutment portion 13 is bent inward and presses against a lower surface of the second abutment portion 22, so that the first abutment portion 13 is pressed against and fixed to the second abutment portion 22. The buckle portion 14 is provided with a straight portion 141 and a blocking portion 142 by bending, and the straight portion 141 is perpendicular to the blocking portion 142. It should be noted here that "perpendicular" does not means perpendicular in a complete mathematical sense, but also includes substantially perpendicular or having a perpendicular tendency. The straight portion 141 abuts against a side wall of the second abutment portion 22, and the blocking portion 142 abuts against the lower surface of the second abutment portion 22, so that the first abutment portion 13 is pressed against and fixed to the second abutment portion 22. The first body 1 is detachably connected to the second body 2, which facilitates the later cleaning and maintenance of the heat exchanger.

Furthermore, a sealing gasket or a sealing ring is provide between the first abutment portion 13 and the second abutment portion 22, which improves the sealing of the heat exchanger. Furthermore, a sealing groove for accommodating the sealing gasket or the sealing ring is provided in one of the first abutment portion 13 and the second abutment portion 22, which facilitates of the sealing between the first abutment portion 13 and the second abutment portion 22, or the sealing grooves for accommodating the sealing gasket or the sealing ring are both provided in the first abutment portion 13 and the second abutment portion 22, the sealing groove in the first abutment portion 13 is staggered with the sealing groove in the second abutment portion 22, for example, after the first abutment portion 13 is aligned with and pressed against the second abutment portion 22, the sealing groove in the first abutment portion 13 is located in an inner ring of the sealing groove in the second abutment portion 22, so as to form a multi-stage seal, thereby improving the sealing of the heat exchanger.

Third Embodiment

The structure and principle of the third embodiment is substantially the same with the second embodiment, and the difference is in that: a clamping edge 23, which extends along the circumferential direction of the first abutment portion 13 toward the direction where the second body 2 is located, is provided on the first abutment portion 13, and the buckle portion 14 is in a straight-line shape.

Figure 7:
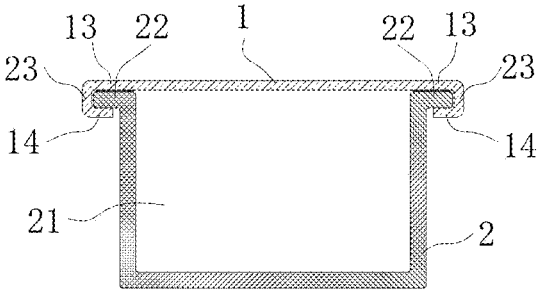
FIG. 7 is a simple schematic assembly view of the first body and the second body in a third embodiment of the present disclosure.

Referring to FIG. 7, a clamping edge 23, which extends along the circumferential direction of the first abutment portion 13 toward the direction where the second body 2 is located, is provided on the first abutment portion 13, a side wall of the second abutment portion 22 abuts against the clamping edge 23, and one end of the buckle portion 14 is connected to a free end of the clamping edge 23. After the first abutment portion 13 is aligned with the second abutment portion 22 and a connection between the buckle portion 14 and the clamping edge 23 is bent, the buckle portion 14 presses against the lower surface of the second abutment portion 22, so that the first abutment portion 13 is pressed against and fixed to the second abutment portion 22. By providing the clamping edge 23, the strength of the first body 1 is improved.

Fourth Embodiment

The structure and principle of the fourth embodiment is substantially the same with the third embodiment, and the difference is in that: the first body 1 includes a U-shaped clamp slot 16, the second abutment portion 22 is accommodated in the clamp slot 16, and one end of the buckle portion 14 is connected to a free end of the clamp slot 16.

Figure 8:
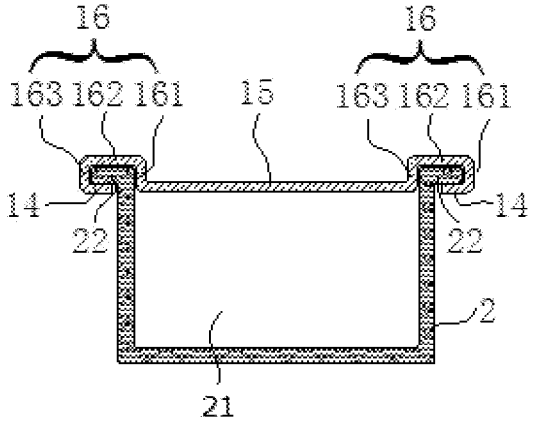
FIG. 8 is a simple schematic assembly view of the first body and the second body in a fourth embodiment of the present disclosure.

Referring to FIG. 8, the first body 1 is in a flat-plate shape, the second body 2 has a U-shaped tank portion 21, an open end of the tank portion 21 extends outward to form a second abutment portion 22, and the first body 1 includes the U-shaped clamp slot 16 and a first body portion 15. The first body portion 15 is provided with a first extending portion 161, which extends along a circumferential direction of the first body portion 15 in a direction away from the first cavity. A second extending portion 162, which extends outward along a circumferential direction of the first extending portion 161, is provided on the first extending portion 161, and a third extending portion 163, which extends along a circumferential direction of the second extending portion 162 toward the direction where the first cavity is located, is provided on the second extending portion 162. The first extending portion 161, the second extending portion 162 and the third extending portion 163 jointly form the clamp slot 16, the second abutment portion 22 is accommodated in the clamp slot 16, that is, two side walls of the second abutment portion 22 abut against the first extending portion 161 and a third extending portion, respectively, a top wall of the second abutment portion 22 abuts against the second extending portion 162, one end of the buckle portion 14 is connected to an end of the third extending portion 163 away from the second extending portion 162, the number of the buckle portions 14 is plural, and these buckle portions 14 are arranged along a circumferential direction of the third extending portion 163. After connections between the buckle portions 14 and the third extending portion 163 are bent, the buckle portions 14 press against the lower surface of the second abutment portion 22 so that the second abutment portion 22 is pressed against and fixed to the third extending portion 163, that is, the buckle portions 14 abut against the second abutment portion 22 so that the second abutment portion 22 is pressed against and fixed in the clamp slot 16. By providing clamp slot 16, the assembly of the first body 1 and the second body 2 is facilitated.

Fifth Embodiment

The structure and principle of the fifth embodiment is substantially the same with the first embodiment, and the difference is in that: a buckle portion 14 is provided on the second body 2, and the buckle portion 14 buckles the first abutment portion 13 and the second abutment portion 22.

Figure 9:
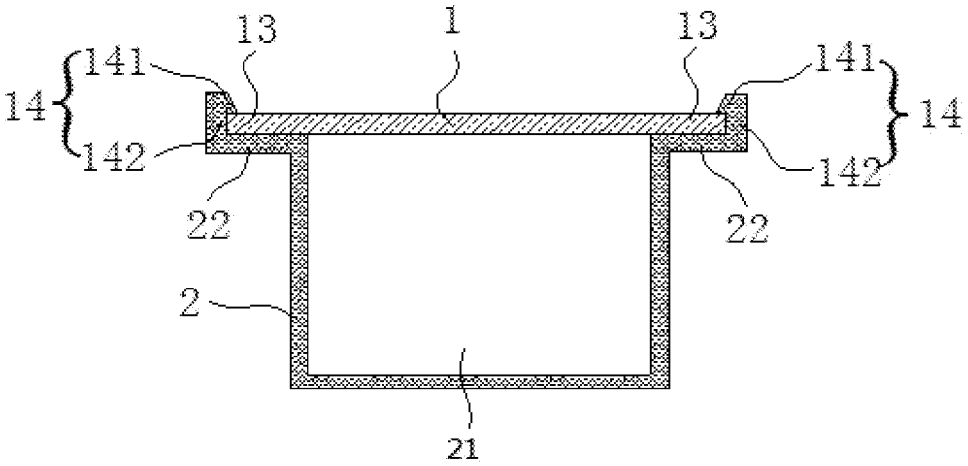
FIG. 9 is a simple schematic assembly view of the first body and the second body in a fifth embodiment of the present disclosure.

Referring to FIG. 9, the second body 2 further includes the buckle portion 14, the buckle portion 14 is arranged along a circumferential direction of the second abutment portion 22, the buckle portion 14 includes a straight portion 142 and a blocking portion 141, one end of the straight portion 142 is connected to the second body 2, the blocking portion 141, which extends toward a direction where the first cavity is located, is provided at the other end of the straight portion 142, a side wall of the blocking portion 141 is inclined, and the first body 1 is placed on the inclined side wall. By applying pressure to the first body 1, the first body 1 is moved toward the direction where the first cavity is located. Since the buckle portion 14 is made of plastic, the straight portion 142 can be bent outward under pressing by the first body 1, and the straight portion 142 returns to its original state due to its own resilience when the first abutment portion 13 is in contact with the second abutment portion 22. At this time, a lower surface of the blocking portion 141 is in contact with and presses against an upper surface of the first abutment portion 13, so that the first abutment portion 13 is pressed against and fixed to the second abutment portion 22.

Besides, the first body 1 includes a U-shaped tank portion 21, and the second body 2 also includes a U-shaped tank portion 21, an open end of the tank portion 21 of the first body 1 is opposite to an open end of the tank portion 21 of the second body 2 and the first body 1 is connected to the second body 2, and the connection location is sealed. Alternatively, the first body 1 has a U-shaped tank portion 21 and the second body 2 is in a flat-plate shape, and the second body 2 covers the tank portion 21 of the first body 1 at the open end thereof and it is also feasible for the connection location to be sealed. The structure and the principle of this embodiment are substantially the same with the above embodiments, which will not be described here.

An assembly method for a heat exchanger is provided according to the present disclosure, the method is applicable to the above heat exchanger, and steps are as follows:

align the first flow-through hole 41, the second flow-through hole 11 and the second flow passage, so that the first flow-through hole 41 is in communication with the second flow passage by the second flow-through hole 11, and then clamp the connecting block 4, the first body 1 and the core body by a clamp;

put the clamped connecting block 4, the first body 1 and the core body into a furnace for welding; and sealingly connect the first body 1 with the second body 2.

The core body and the connecting block 4 are both welded to the first body so as to form an integral whole after welding, which is then directly assembled with the second body 2, which saves the assembly process and saves cost.

Although the embodiments of the present application have been illustrated and described above, it should be understood that the embodiments described above are only exemplary, and are not understood as limitation for the present application, changes, modifications, substitutions and alternations can be made on the embodiments described above by those skilled in the art within the scope of the present application.

The invention claimed is:

1. A heat exchanger, comprising a housing and a core body accommodated in the housing, wherein the housing comprises a first body and a second body, the first body is made of metal, the second body is made of plastic, and the first body and the second body are connected to form a first cavity;

the core body is accommodated in the first cavity, the core body is fixedly connected to the first body, the core body comprises a plurality of heat exchange pipes, the plurality of heat exchange pipes are stacked, a first fluid passage is formed between the plurality of heat exchange pipes, a second fluid passage is formed inside the plurality of heat exchange pipes, and the first fluid passage is not in communication with the second fluid passage;

the heat exchanger further comprises a connecting block, the connecting block is fixedly arranged on a side of the first body away from the core body and fixed to the first body and the connecting block is located outside the housing, the connecting block and the core body are arranged on two opposite sides of the first body of the housing, respectively, a first flow-through hole is provided in the connecting block, a second flow-through hole is provided in the first body, and the first flow-through hole and the second fluid passage are in fluid communication through the second flow-through hole, wherein the core body comprises a collecting pipe, the second flow-through hole is in communication with the plurality of heat exchange pipes through the collecting pipe, a protruding portion, which extends from the second flow-through hole toward a side where the core body is located, is provided at a side of the first body opposite to the connecting block, and the protruding portion extends into the collecting pipe through an opening of the collecting pipe when the first body is assembled with the core body, wherein an outer wall of the protruding portion in contact with the collecting pipe is provided with a solder composite layer, the protruding portion is welded to an inner side wall of the collecting pipe by the solder composite layer.

2. The heat exchanger according to claim 1, wherein the first body is in a flat-plate shape, the second body has a U-shaped tank portion, the first body covers at an open end of the tank portion of the second body and a connection between the first body and the second body is sealed;

or, the first body has a U-shaped tank portion, the second body also has a U-shaped tank portion, an open end of the tank portion of the first body is opposite to an open end of the tank portion of the second body and a connection between the first body and the second body is sealed;

or, the first body has a U-shaped tank portion, the second body is in a flat-plate shape, the second body covers at an open end of the tank portion of the first body and a connection between the first body and the second body is sealed.

3. The heat exchanger according to claim 2, wherein the first body comprises a first abutment portion, the second body comprises a second abutment body, the first abutment portion is connected to the second abutment portion.

4. The heat exchanger according to claim 3, wherein a clamping edge, which extends along a circumferential direction of the second abutment portion toward a direction where the first body is located, is provided on the second abutment portion, and a side wall of the first abutment portion abuts against the clamping edge.

5. The heat exchanger according to claim 3, wherein the first body further comprises a buckle portion, one end of the buckle portion is connected to the first abutment portion, at least part of the buckle portion abuts against the second abutment portion so that the first abutment portion is pressed against and fixed to the second abutment portion.

6. The heat exchanger according to claim 5, wherein the buckle portion comprises a straight portion and a blocking portion, one end of the straight portion is connected to the first abutment portion, the other end of the straight portion is connected to one end of the blocking portion, the straight portion is perpendicular to the blocking portion, the straight portion abuts against a side wall of the second abutment portion, and the blocking portion abuts against the second abutment portion so that the first abutment portion is pressed against and fixed to the second abutment portion.

7. The heat exchanger according to claim 5, wherein a clamping edge, which extends along a circumferential direction of the first abutment portion toward a direction where the second body is located, is provided on the first abutment portion, and a side wall of the second abutment portion abuts against the clamping edge, one end of the buckle portion is connected to a free end of the clamping edge, and the buckle portion abuts against the second abutment portion so that the first abutment portion is pressed against and fixed to the second abutment portion.

8. The heat exchanger according to claim 2, wherein the first body is in a flat-plate shape, the second body has a U-shaped tank portion, an open end of the tank portion extends outward to form a second abutment portion, the first body comprises a U-shaped clamp slot, the second abutment portion is accommodated in the clamp slot, one end of the buckle portion is connected to a free end of the clamp slot, and the buckle portion abuts against the second abutment portion so that the second abutment portion is pressed against and fixed in the clamp slot.

9. The heat exchanger according to claim 8, wherein the first body comprises a first body portion, a first extending portion is provided on the first body portion along a circumferential direction of the first body portion away from a direction where the first cavity is located, a second extending portion, which extends outward along a circumferential direction of the first extending portion is provided on the first extending portion, a third extending portion, which extends along a circumferential direction of the second extending portion toward the direction where the first cavity is located, is provided on the second extending portion, and the first extending portion, the second extending portion and the third extending portion jointly form the clamp slot.

10. The heat exchanger according to claim 3, wherein the second body further comprises a buckle portion, the buckle portion is made of plastic, the buckle portion comprises a straight portion and a blocking portion, one end of the straight portion is connected to the second abutment portion, the blocking portion, which extends toward a direction where the first cavity is located, is provided at the other end of the straight portion, and the blocking portion abuts against the first abutment portion so that the first abutment portion is pressed against and fixed to the second abutment portion.

11. The heat exchanger according to claim 2, wherein the core body comprises a first collecting assembly, the first collecting assembly comprises a collecting pipe, a flow-through plate and a first connecting plate, a plurality of first heat exchange pipe mounting grooves are provided on the first connecting plate along a length direction of the first connecting plate, one end of the plurality of heat exchange pipes is arranged in the plurality of first heat exchange pipe mounting grooves, the collecting pipe is arranged on a side of the first connecting plate away from the plurality of heat exchange pipes, the flow-through plate is arranged between the collecting pipe and the first connecting plate, and distribution passages are provided on the flow-through plate along an arrangement direction of the plurality of first heat exchange pipe mounting grooves;

the collecting pipe is arranged in a plate body, hemming parts are provided on two sides of the first connecting plate, and two sides of the flow-through plate and two sides of the plate body are press-fitted in the hemming parts.

12. The heat exchanger according to claim 1, wherein the core body comprises a second collecting assembly, the second collecting assembly comprises a enclosure plate, a baffle plate and a second connecting plate, a plurality of second heat exchange pipe mounting grooves are provided on the second connecting plate along a length direction of the second connecting plate, one end of the plurality of heat exchange pipes is arranged in the plurality of second heat exchange pipe mounting grooves, the enclosure plate is arranged on a side of the second connecting plate away from the plurality of heat exchange pipes, the baffle plate is arranged between the enclosure plate and the second connecting plate, and baffle passages in communication with the plurality of second heat exchange pipe mounting grooves are provided in the baffle plate along an arrangement direction of the plurality of second heat exchange pipe mounting grooves, to form a U-shaped circuit;

hemming parts are provided on two sides of the second connecting plate, and two sides of the baffle plate and two sides of the enclosure plate are press-fitted in the hemming parts.

13. The heat exchanger according to claim 2, wherein a U-shaped tank portion is provided in one of the first body and the second body, an arc portion protruding outward is provided on a side plate of the one of the first body and the second body, a first hole is formed between the arc portion and the core body, and a second hole in communication with the first hole is provided on the other one of the first body and the second body.

14. An assembly method for a heat exchanger, wherein the heat exchanger is the heat exchanger according to claim 1, the assembly method for the heat exchanger comprises:

align the first flow-through hole, the second flow-through hole and the second flow passages, so that the first flow-through hole and the second flow passages being in communication by the second flow-through hole, and then clamp the connecting block, the first body and the core body by a clamp;

put the clamped connecting block, the first body and the core body into a furnace for welding; and sealingly connect the first body with the second body.

15. The heat exchanger according to claim 8, wherein the core body comprises a second collecting assembly, the second collecting assembly comprises a enclosure plate, a baffle plate and a second connecting plate, a plurality of second heat exchange pipe mounting grooves are provided on the second connecting plate along a length direction of the second connecting plate, one end of the plurality of heat exchange pipes is arranged in the plurality of second heat exchange pipe mounting grooves, the enclosure plate is arranged on a side of the second connecting plate away from the plurality of heat exchange pipes, the baffle plate is arranged between the enclosure plate and the second connecting plate, and baffles passage in communication with the plurality of second heat exchange pipe mounting grooves are provided in the baffle plate along an arrangement direction of the plurality of second heat exchange pipe mounting grooves, to form a U-shaped circuit;

hemming parts are provided on two sides of the second connecting plate, and two sides of the baffle plate and two sides of the enclosure plate are press-fitted in the hemming parts.

16. The heat exchanger according to claim 9, wherein the core body comprises a second collecting assembly, the second collecting assembly comprises a enclosure plate, a baffle plate and a second connecting plate, a plurality of second heat exchange pipe mounting grooves are provided on the second connecting plate along a length direction of the second connecting plate, one end of the plurality of heat exchange pipes is arranged in the plurality of second heat exchange pipe mounting grooves, the enclosure plate is arranged on a side of the second connecting plate away from the plurality of heat exchange pipes, the baffle plate is arranged between the enclosure plate and the second connecting plate, and baffles passage in communication with the plurality of second heat exchange pipe mounting grooves are provided in the baffle plate along an arrangement direction of the plurality of second heat exchange pipe mounting grooves, to form a U-shaped circuit;

hemming parts are provided on two sides of the second connecting plate, and two sides of the baffle plate and two sides of the enclosure plate are press-fitted in the hemming parts.

17. The heat exchanger according to claim 11, wherein the core body comprises a second collecting assembly, the second collecting assembly comprises a enclosure plate, a baffle plate and a second connecting plate, a plurality of second heat exchange pipe mounting grooves are provided on the second connecting plate along a length direction of the second connecting plate, one end of the plurality of heat exchange pipes is arranged in the plurality of second heat exchange pipe mounting grooves, the enclosure plate is arranged on a side of the second connecting plate away from the plurality of heat exchange pipes, the baffle plate is arranged between the enclosure plate and the second connecting plate, and baffles passage in communication with the plurality of second heat exchange pipe mounting grooves are provided in the baffle plate along an arrangement direction of the plurality of second heat exchange pipe mounting grooves, to form a U-shaped circuit;

hemming parts are provided on two sides of the second connecting plate, and two sides of the baffle plate and two sides of the enclosure plate are press-fitted in the hemming parts.

* * * * *